United States Patent [19]

Baranyi et al.

[11] Patent Number: 4,925,760

[45] Date of Patent: May 15, 1990

[54] PYRANTHRONE PHOTOCONDUCTOR IMAGING MEMBERS

[75] Inventors: Giuseppa Baranyi; Ah-Mee Hor, both of Mississauga; Rafik O. Loutfy, Willowdale; Zoran D. Popovic, Mississauga, all of Canada

[73] Assignee: Xerox Corporation, Stamford, Conn.

[21] Appl. No.: 215,099

[22] Filed: Jul. 5, 1988

[51] Int. Cl.[5] ..... G03G 5/06

[52] U.S. Cl. ..... 430/59; 430/65; 430/72; 430/128

[58] Field of Search ..... 430/57, 58, 59, 71, 430/76, 78, 65, 72, 128

[56] References Cited

U.S. PATENT DOCUMENTS

| | | | |
|---|---|---|---|
| 3,871,882 | 3/1975 | Wiedemann | 96/1.5 |
| 3,877,935 | 4/1975 | Regensburger et al. | 96/1.5 |
| 3,973,959 | 8/1976 | Rochlitz et al. | 96/1.5 |
| 4,315,981 | 2/1982 | Wiedemann | 430/59 |
| 4,431,722 | 2/1984 | Takei et al. | 430/58 |
| 4,792,508 | 12/1988 | Kazmaier et al. | 430/59 |

FOREIGN PATENT DOCUMENTS 59184349 4/1978 Japan .

*Primary Examiner*—John L. Goodrow
*Attorney, Agent, or Firm*—E. O. Palazzo

[57] ABSTRACT

Disclosed is an improved layered photoresponsive imaging member comprised of a supporting substrate, a vacuum evaporated photogenerator layer comprised of certain pyranthrone pigments including tribromo-8,16-pyranthrenedione and trichloro-8,16-pyranthrenedione; and an aryl amine hole transport layer comprised of molecules of the following formula:

dispersed in a resinous binder and wherein X is selected from the group consisting of halogen and alkyl.

35 Claims, 4 Drawing Sheets

PYRANTHRONE PHOTOCONDUCTOR IMAGING MEMBERS

BACKGROUND OF THE INVENTION

This invention is generally directed to layered photoresponsive imaging members, and more specifically to photoconductive members having incorporated therein certain pyranthrone compounds. In one embodiment of the present invention, there are provided organic photoconductive layered imaging members comprised of certain pyranthrone compounds and aryl amine hole transport layers. Further, in one important embodiment of the present invention there is provided a photoresponsive imaging member or device comprised of pyranthrones selected from tribromo-8,16-pyranthrenedione (Paliogen Red L3530), and trichloro-8,16-pyranthrenedione (Paliogen Orange L2640), and the derivatives thereof; and an aryl amine hole transport layer. The aforementioned photoconductive members possess a number of advantages indicated hereinafter inclusive of high photosensitivity, low residual potentials, low dark decay characteristics, stable cycling properties; and are easily sublimable. Accordingly, the photoresponsive imaging members of the present invention can be selected for various electrophotographic imaging and printing processes wherein, for example, latent images are formed thereon followed by development and transfer to a suitable substrate.

Illustrated in U.S. Pat. No. 4,315,981 are organic double layered electrophotographic recording materials consisting of an electroconductive support with a photoconductive double layer of organic materials, which consist of a homogeneous opaque charge carrier producing dyestuff layer obtained from a more annealed quinone, or the substitution product thereof selected from the group consisting of dibenzopylene, quinone, anthraquinone, pyranthrone, dibenzathrone, and flaventhrone, and a transparent top layer of insulating materials of at least one charge transporting compound, which transport layer consists of a charge transporting monomer, reference for example column 2, lines 37 to 56. Further, as indicated in column 4, lines 1 to 22, as the formula 9 compound for the imaging member of '981 there can be selected dibromo-8,16-pyranthrenedione (Indanthrene Orange RRTS, C.I. 59,705). Moreover, it is stated in column 4, begining at around line 53, that the organic dyestuff layer may be applied by vapor depositing the dyestuff in a vacuum. Also, this patent discloses a number of resinous binders for the charge transport layer including polycarbonate resins, reference column 7. Further, in U.S. Pat. No. 3,871,882 there are disclosed layered electrophotographic recording materials containing an electroconductive support material and a photoconductive double layer of organic materials, reference for example the Abstract of the Disclosure. Other representative patents of background interest include U.S. Pat. Nos. 3,871,882 and 3,973,959.

Furthermore, in Konishiroku Kokai Japanese 59/184349/A2[84/184349], 19 Oct. 1984, there is disclosed the use of selected pyranthrones as charge generator layers in conjunction with hydrazone charge transport layers. Specifically, a solution coated dispersion of dibromo-8,16-pyranthrenedione in a polymer binder can be selected as the charge generator layer. Also, in U.S. Pat. No. 3,877,935 there are disclosed imaging members with dibromo-8,16-pyranthrenedione vacuum coated charge generator layers contiguous with poly(vinyl carbazole) charge transport layers.

Additionally, numerous different xerographic photoconductive members are known including, for example, a homogenerous layer of a single material such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photoconductive inorganic compound dispersed in an electrically insulating organic resin binder. These members contain, for example, coated on a paper backing a binder layer containing particles of zinc oxide uniformly dispersed therein. The binder materials disclosed in this patent comprise a material such as polycarbonate resins, polyester resins, polyamide resins, and the like, which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain quality images.

Also, there have been disclosed other layered photoresponsive devices including those comprised of separate generating layers, and transport layers as described in U.S. Pat. No. 4,265,990, the disclosure of which is totally incorporated herein by reference. Examples of photogenerating layers disclosed in this patent include trigonal selenium and phthalocyanines, while examples of transport layers include certain diamines as mentioned herein.

Many other patents are in existence describing photoresponsive devices including layered devices containing generating substances, such as U.S. Pat. No. 3,041,167 which discloses an overcoated imaging member containing a conductive substrate, a photoconductive layer, and an overcoating layer of an electrically insulating polymeric material. This member is utilized in an electrophotographic copying system by, for example, initially charging the member with an electrostatic charge of a first polarity, and imagewise exposing to form an electrostatic latent image, which can be subsequently developed to form a visible image.

Furthermore, there are disclosed in U.S. Pat. Nos. 4,232,102 and 4,233,383 photoresponsive imaging members comprised of trigonal selenium doped with sodium carbonate, sodium selenite, and trigonal selenium doped with barium carbonate, and barium selenite, or mixtures thereof. Moreover, there are disclosed in U.S. Pat. No. 3,824,099 certain photosensitive hydroxy squaraine compositions. According to the disclosure of this patent, the squaraine compositions are photosensitive in normal electrostatographic imaging systems.

In U.S. Pat. No. 4,508,803, the disclosure of which is totally incorporated herein by reference, there is described an improved photoresponsive device comprised of a supporting substrate, a hole blocking layer, an optional adhesive interface layer, an inorganic photogenerating layer, a photoconducting composition layer comprised of benzyl fluorinated squaraine compositions, and a hole transport layer. Other representative patents disclosing photoconductive devices with squaraine components therein, or processes for the preparation of squaraines include U.S. Pat. Nos. 4,507,408; 4,552,822; 4,559,286; 4,507,480; 4,524,220; 4,524,219; 4,524,218; 4,525,592; 4,559,286; 4,415,639; 4,471,041; and 4,486,520. The disclosures of each of the aforementioned patents are totally incorporated herein by reference.

Moreover, disclosed in the prior art are composite electrophotographic photosensitive materials with various azo compounds. For example, there is illustrated in Japanese Ricoh Patent Publication 6064354, published April 12, 1985, composite photoconductors wherein one of the photoconductor layers contain an azo compound of the formulas as illustrated. Further, there are illustrated in several U.S. patents and publications layered organic electrophotographic photoconductor elements with azo, bisazo, or related compounds. Examples of these patents and publications include U.S. Pat. Nos. 4,400,455; 4,551,404; 4,390,608; 4,327,168; 4,299,896; 4,314,015; 4,486,522; 4,486,519; and 4,551,404; and Konishiroku Japanese Patent Laid Open Publication 60111247.

Although photoconductive imaging members are known, there remains a need for members with other photogenerator layers. Additionally, there continues to be a need for layered photoresponsive imaging members having incorporated therein certain pyranthrone compounds, which members will enable the generation of acceptable high quality images and wherein these members can be repeatedly used in a number of imaging cycles without deterioration thereof from the machine environment or surrounding conditions. Moreover, there is a need for improved layered photoresponsive imaging members wherein the pyranthrone compounds selected for one of the layers in combination with specific aryl amine charge transport compositions are substantially inert to the users of such members. Additionally, there is an important need for layered photoconductors with pyranthrone compounds, which photoconductors are of high sensitivity, have low dark decay values, low residual potentials, and possess high cyclic stability. Furthermore, there continues to be a need for photoresponsive imaging members which can be positively or negatively charged thus permitting the development of images, including color images, with positively or negatively charged toner compositions. Moreover, there continues to be an important need for disposable imaging members with nontoxic organic pigments. Also, there is a need for disposable imaging members useful in xerographic imaging processes, and xerographic printing systems wherein, for example, light emitting diodes (LED), helium cadmium or helium-neon lasers can be selected; and wherein these members are particularly sensitive to the visible region of the spectrum, that is from about 400 to about 700 nanometers. Also, there is a need for low cost, high quality imaging members wherein reduced amounts of photosensitive materials can be selected.

SUMMARY OF THE INVENTION

It is therefore an object of the present invention to provide photoresponsive imaging members containing therein certain pyranthrone compounds.

A further object of the present invention is the provision of improved photoconductive imaging members with high photosensitivity, low residual potentials, low dark decay values, and excellent cyclic stability.

Additionally, in a further object of the present invention there are provided disposable photoconductive imaging members.

Another object of the present invention resides in the provision of organic layered photoconductive imaging members containing therein certain vacuum evaporated pyranthrone compounds as photogenerating layers and aryl amine hole transport layers.

In yet another specific object of the present invention there are provided negatively charged layered photoresponsive imaging members comprised of certain vacuum evaporated fractionally sublimed pyranthrone pigment compositions optionally dispersed in a resinous binder, and thereon a hole transport layer comprised of aryl amine molecules.

There are provided in another object of the present invention positively charged layered photoresponsive imaging members with a top vacuum evaporated photogenerating layer comprised of certain pyranthrone pigments optionally dispersed in a resinous binder, and thereunder a hole transport layer comprised of aryl amine molecules.

Further, in yet another object of the present invention there are provided imaging and printing methods with the improved photoresponsive imaging members illustrated herein.

Also, in a further important object of the present invention there are provided improved imaging members sensitive to light in the visible region of the spectrum, that is, from about 400 to about 700 nanometers.

These and other objects of the present invention are accomplished by the provision of layered photoconductive imaging members containing therein certain pyranthrone compounds. More specifically, the layered photoconductive imaging members of the present invention are comprised of specific vacuum evaporated fractionally sublimed pyranthrone compounds, which function as a photogenerating source, and in contact therewith an aryl hole transport layer.

Accordingly, the photoconductive layered imaging members of the present invention are comprised of, for example, a supporting substrate, an aryl diamine hole transport layer, and trihalogenated pyranthrones encompassed by the Formula. More specifically, preferred pyranthrones include those wherein n is the number 3, and the halogen is bromide or chloride, such as tribromo-8,16-pyranthrenedione and trichloro-8,16-pyranthrenedione, which are commercially available from BASF as Paliogen Red L3530 (Pigment Red 216) and Paliogen Orange L2640 (Pigment Orange 51), respectively.

The pyranthrone compounds selected for the imaging members of the present invention are represented generally by the following Formula

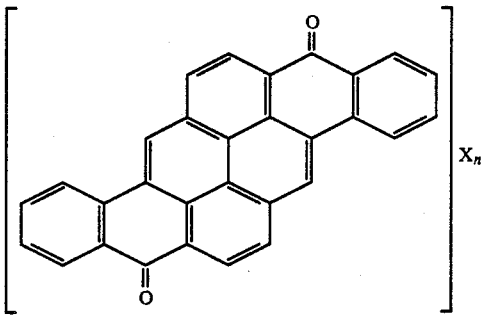

wherein X is halogen such as chloride, iodide, fluoride, bromide, nitro, cyano, or acetate; and n is the number 3 to 4, and preferably 3 or 4.

With further respect to the photoconductive imaging members of the present invention, the photogenerating pyranthrone compounds can be situated between the supporting substrate and the aryl amine hole transport layer; or alternatively, the aryl amine hole transport layer may be situated between the supporting substrate and the layer comprised of the photogenerating pyranthrone compounds illustrated herein.

In another specific illustrative embodiment, the improved photoconductive imaging member of the present invention is comprised of (1) a supporting substrate; (2) a hole blocking layer; (3) an optional adhesive interface layer; (4) a photogenerating layer comprised of the pyranthrone compounds of the Formula illustrated, and (5) an aryl amine hole transport layer. Therefore, the photoconductive imaging member of the present invention in one important embodiment is comprised of a conductive supporting substrate, a hole blocking silane or metal oxide layer in contact therewith, an adhesive layer, a photogenerating layer comprised of pyranthrone compounds representated by the Formula illustrated overcoated on the adhesive layer, and as a top layer a hole transport layer comprised of certain aryl amines dispersed in a resinous binder.

Various known processes can be selected for the preparation of the photoconductive imaging members of the present invention, the process parameters in the order of coating of the layers being dependent on the member desired. Specifically, for example, in one method the pyranthrone photogenerating layer is deposited on a supporting substrate by vacuum sublimation, and subsequently the hole transport layer is deposited thereover by solution coating. In another process variant, the layered photoconductive device can be prepared by providing the conductive substrate containing the hole blocking layer and an optional adhesive layer, and applying thereto by solvent coating processes, laminating processes, or other methods, the pyranthrone photogenerating layer, and the aryl amine hole transport layer.

Also, in a preferred embodiment of the present invention the pyranthrone compounds represented by the Formula are purified prior to incorporation in the imaging members by fractional sublimation, which involves subjecting the pigment pyranthrone of the Formula illustrated herein to a temperature of from about 200° to 450° C., whereby impurities and decomposition products more volatile than the desired components are separated at a temperature zone of below 200° C. There are thus obtained the desired purified pyranthrone components at a purity of at least about 95 percent at a temperature zone of from about 290° to 350° C. separated from the nonvolatile impurities, which remain at the high temperature (450° C.) zone.

The improved photoconductive imaging members of the present invention can be incorporated into numerous imaging processes and apparatuses inclusive of those well known in the art such as xerographic imaging and printing processes. Specifically, the imaging members of the present invention are useful in xerographic imaging processes wherein the pyranthrone pigments absorb light of a wavelength of from about 400 nanometers to about 600 nanometers. In these processes, electrostatic latent images are initially formed on the imaging member followed by development, and thereafter transferring the image to a suitable substrate.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Preferred embodiments will now be illustrated with reference to specific photoconductive imaging members containing the pyranthrone compounds illustrated herein.

Figure 1:
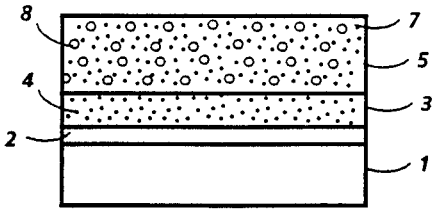
FIG. 1 is a partially schematic cross-sectional view of a negatively charged photoresponsive imaging member of the present invention.

Illustrated in FIG. 1 is a negatively charged photoresponsive imaging member of the present invention comprised of a substrate 1, an adhesive layer 2, a vacuum evaporated photogenerator layer 3 comprised of a pyranthrone pigment selected from the group consisting of those represented by Formula I and preferably tribromo-8,16-pyranthrenedione and trichloro-8,16-pyranthrenedione available from BASF as Paliogen Red L3530 (Pigment Red 216) or vacuum evaporated fractionally sublimed Paliogen Orange L2640 (Pigment Orange 51) respectively; optionally dispersed in a resinous binder composition 4 and a charge carrier hole transport layer 5 comprised of an aryl amine such as N,N'-diphenyl-N,N'-bis(3-methylphenyl)-[1,1'-biphenyl]-4,4'-diamine 7 dispersed in a polycarbonate resinous binder 8.

Figure 2:
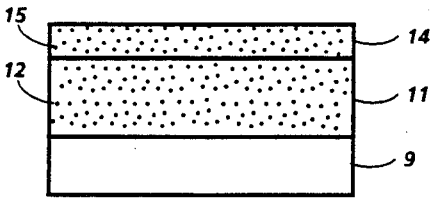
FIG. 2 is a partially schematic cross-sectional view of a positively charged photoresponsive imaging member of the present invention.

Illustrated in FIG. 2 is essentially the same member as shown in FIG. 1 with the exception that the hole transport layer is situated between the supporting substrate and the photogenerating layer. More specifically, with reference to this Figure, there is illustrated a photoconductive imaging member comprised of a supporting substrate 9, a hole transport layer 11 comprised of the aryl amine hole transport composition dispersed in an inactive resinous binder composition 12, and a photogenerating layer 14 comprised of a pyranthrone compound selected from the group consisting of those compounds represented by Formula I optionally dispersed in a resinous binder composition 15.

Figure 3:
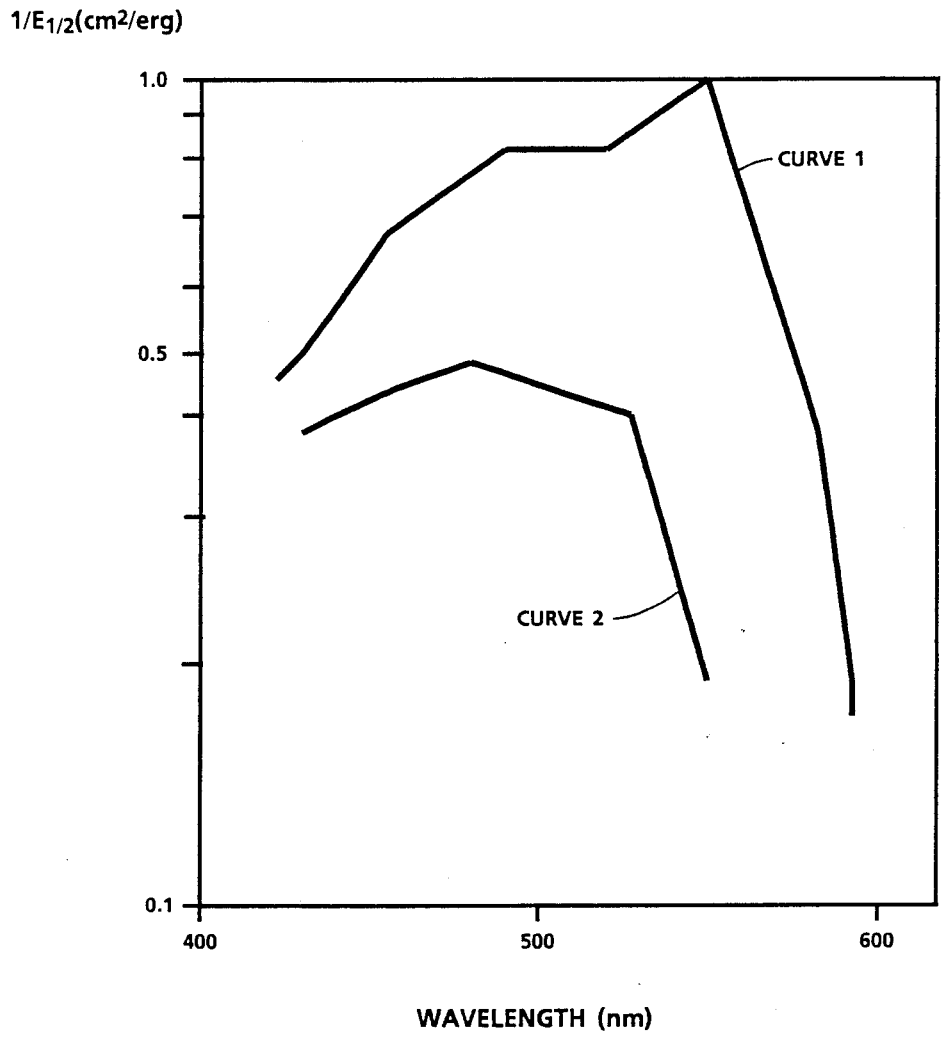
FIG. 3 is a line graph illustrating the spectral response of specific pyranthrone pigments of the present invention.

Illustrated in FIG. 3 is a plot of the $1/E_{\frac{1}{2}}$ value versus wavelength in nanometers for photoresponsive imaging members prepared in accordance with Examples III and IV. Specifically, Curve 1 represents the light sensitivity of the imaging member of Example III, and Curve 2 represents the light sensitivity of the imaging member of Example IV.

Figure 4:
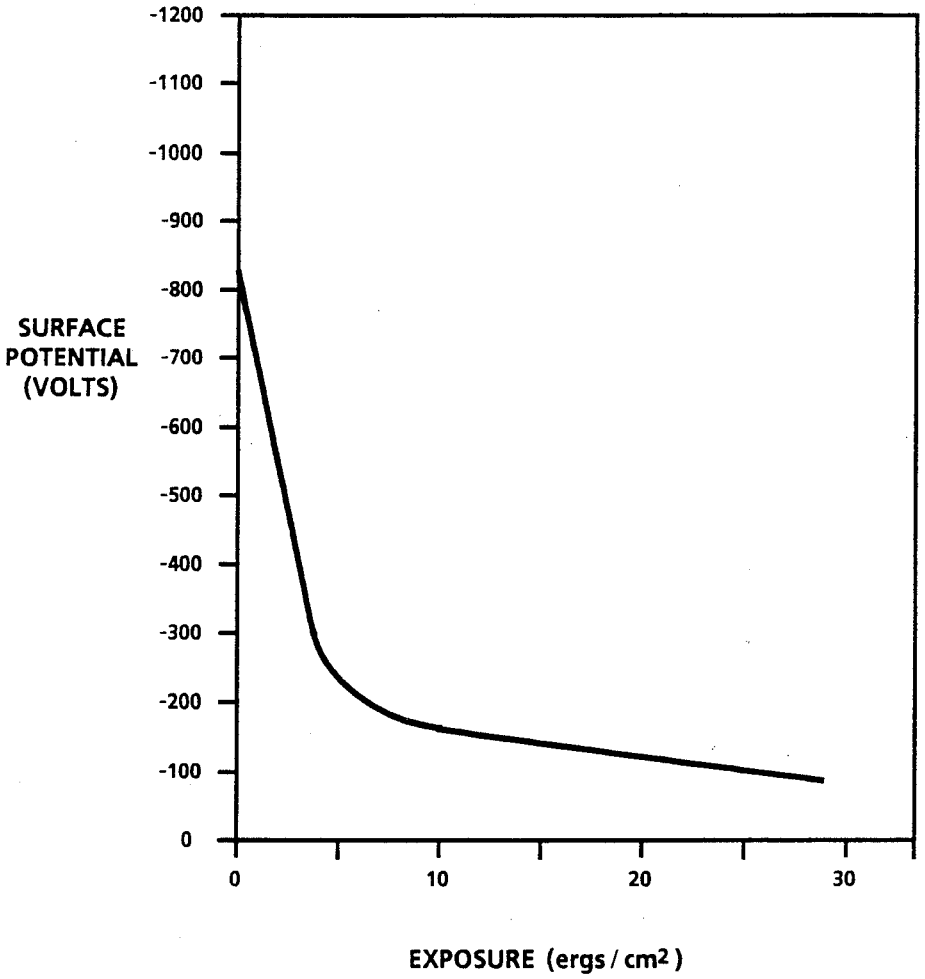
FIGS. 4 and 5 are photosensitivity line graph curves for specific imaging members of the present invention.

FIG. 4 illustrates the photosensitivity curve for the imaging member of Example III wherein the surface potential thereof is plotted against the light exposure energies recited.

Figure 5:
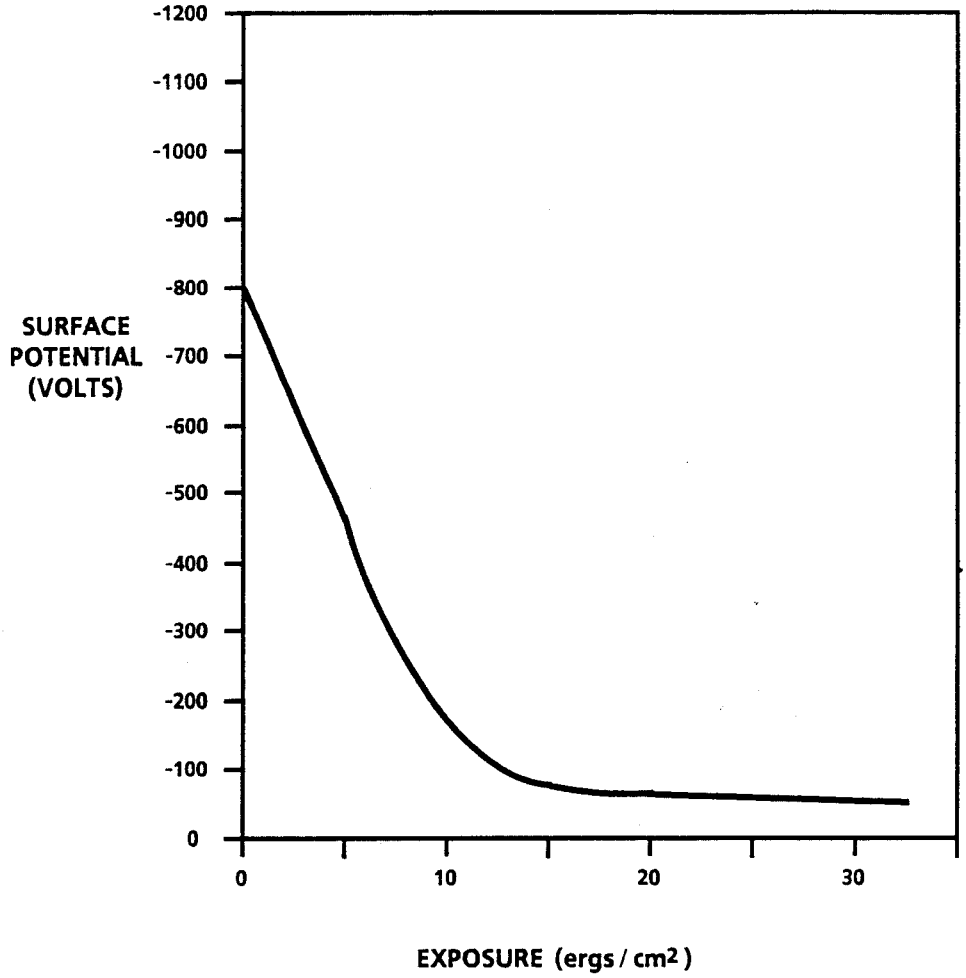

FIG. 5 illustrates the photosensitivity curve for the imaging member of Example IV wherein the surface potential thereof is plotted against the light exposure energies recited.

Other photoconductive imaging members not specifically illustrated are encompassed within the scope of the present invention including those wherein the pyranthrone compound is of the structure described in Formula I where X is iodo, fluoro, nitro, cyano or acetate, and n is the number 3 or 4.

With further reference to FIGS. 1 to 5, the substrates may comprise a layer of insulating material such as an inorganic or organic polymeric material, including Mylar a commercially available polymer; a layer of an organic or inorganic material having a semiconductive surface layer such as indium tin oxide or aluminum arranged thereon, or a conductive material such as, for example, aluminum, chromium, nickel, titanium, brass, or the like. The substrate may be flexible or rigid and many have a number of many different configurations, such as for example, a plate, a cylindrical drum, a scroll, an endless flexible belt, and the like. Preferably, the substrate is in the form of an endless flexible belt. In some situations, it may be desirable to coat on the back of the substrate, particularly when the substrate is an organic polymeric material, an anticurl layer, such as for example, polycarbonate materials commercially available as Makrolon. The thickness of the substrate layer depends on many factors, including economical considerations, thus this layer may be of substantial thickness, for example over 100 mils, or of minimum thickness providing there are no adverse effects on the system. In one preferred embodiment, the thickness of this layer is from about 3 mils to about 10 mils.

The adhesive layers are typically comprised of a polymeric material including polyesters, poly(vinyl butyral), poly(vinyl pyrrolidone), and the like. Typically, this layer is of a thickness of less than about 0.1 micron. The imaging member of the present invention can include other layers therein as illustrated hereinbefore, including metal oxide layers such as aluminum oxide and siloxanes, reference U.S. Pat. No. 4,464,450, the disclosure of which is totally incorporated herein by reference. Generally, the thickness of these layers is from about 0.5 to about 1 micron, however, other thicknesses can be selected providing the objectives of the present invention are achieved.

The photogenerating layers are generally of a thickness of from about 0.05 micron to about 10 microns, or more; and preferably are of a thickness of from about 0.1 micron to about 3 microns; however, the thickness of this layer is primarily dependent on the photogenerator weight loading which may vary from about 5 to 100 percent. Generally, it is desirable to provide this layer in a thickness which is sufficient to absorb about 90 percent or more of the incident radiation which is directed upon it, and the imagewise or printing exposure step. The maximum thickness of this layer is dependent primarily upon factors such as mechanical considerations, for example, whether a flexible photoconductive imaging member is desired, the thicknesses of the outer layers, and the specific pyranthrone compound selected.

Various suitable aryl amine charge transport layers can be selected for the photoconductive imaging member of the present invention, which layer has a thickness of from about 5 microns to about 50 microns; and preferably is of a thickness of from about 10 microns to about 40 microns. In a preferred embodiment, this transport layer comprises aryl amine molecules of the following formula

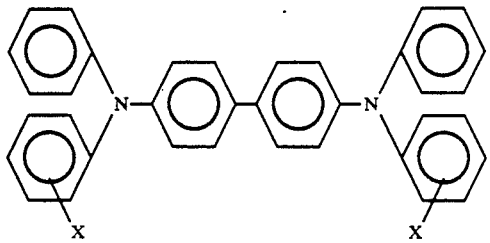

dispersed in a highly insulating and transparent organic resinous binder wherein X is selected from the group consisting of alkyl and halogen; and preferably (ortho) $CH_3$, (meta) $CH_3$, (para) $CH_3$, (ortho) Cl, (meta) Cl, or (para) Cl.

Compounds corresponding to the above formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl, and 4-methyl, ethyl, propyl, butyl, hexyl, and the like. With halo substitution, the amine is N,N'-diphenyl-N,N'-bis(halo phenyl)-[1,1'-biphenyl]-4,4'-diamine wherein halo is 2-chloro, 3-chloro, or 4-chloro.

Examples of the highly insluating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyester, polysiloxanes, polyamides, polyurethanes and epoxies as well as block, random or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also included within the scope of the present invention are methods of imaging with the photoresponsive devices illustrated herein. These methods generally involve the formation of an electrostatic latent image on the imaging member, followed by developing the image with known developer compositions, reference for example U.S. Pat. Nos. 3,590,000; 4,469,770; 4,560,635 and 4,298,672, the disclosures of which are totally incorporated herein by reference; subsequently transferring the image to a suitable substrate; and permanently affixing the image thereto.

The invention will now be described in detail with reference to specific preferred embodiments thereof, it being understood that these examples are intended to be illustrative only. The invention is not intended to be limited to the materials, conditions, or process parameters recited herein. Also, all parts and percentages are by weight unless otherwise indicated.

EXAMPLE I

Purification of Paliogen Red L3530

Two grams of Paliogen Red L3530 obtained from BASF were placed at about 5 inches from one end, and inside a pyrex tube (outer diameter 1 inch, length 28 inches). The tube was then placed inside a furnace comprised of a thick wall (0.5 inch thickness) copper tube wrapped with two electrical heater bands at one end and water cooling coils at the other end. A temperature gradient of from 440° to 25° was achieved along the length of the tube which was monitored by thermocouple probes. The pyrex tube was positioned such that the tribrominated pyranthrone L3530 to be sublimed was located within the heater bands. Thereafter, the pyranthrone was heated to about 440° C. and the vapors produced were swept toward the lower temperature end by a flow of low pressure (2 mbar) nitrogen carrier gas. Pyranthrone vapor was condensed to form a distinct reddish deposit at a certain location where the temperature was between 350° and 330° C., whereas the more volatile impurities were deposited below 300° C., and thus separated from the purified tribrominated Red L3530 pyranthrone. There remained a small amount of unsublimed residue where the Paliogen Red L3530 pigment was originally placed.

The purified brominated Red L3530 pyranthrone, about 0.7 gram, was obtained in a yield of about 35 percent.

EXAMPLE II

Purification of Paliogen Orange L2640

Two grams of Paliogen Orange L2640 obtained from BASF were placed at about 5 inches from one end, and inside a pyrex tube (outer diameter 1 inch, length 28 inches). The tube was then placed inside a furnace comprised of a thick wall (0.5 inch thickness) copper tube wrapped with two electrical heater bands at one end and water cooling coils at the other end. A temperature gradient of from 415° to 25° was achieved along the length of the tube which was monitored by thermocouple probes. The pyrex tube was positioned such that the trichlorinated pyranthrone L2640 to be sublimed was located within the heater bands. Thereafter, the pyranthrone was heated to about 415° C. and the vapors produced were swept toward the lower temperature end by a flow of low pressure (2 mbar) nitrogen carrier gas. Pyranthrone vapor was condensed to form a distinct orange deposit at a certain location where the temperature was between 338° and 290° C., whereas the more volatile impurities were deposited below 235° C., and thus separated from the purified L2640 trichlorinated pyranthrone. There remained a small amount of unsublimed residue where the Paliogen Red L3530 pigment was originally placed.

The purified L2640 trichlorinated pyranthrone, 1.66 grams, was obtained in a yield of about 83 percent.

EXAMPLE III

Photoresponsive imaging members were prepared by providing a titanized Mylar substrate in a thickness of 75 microns with a layer of N-methyl-3-aminopropyl triethoxysilane and a DuPont 49,000 polyester adhesive layer thereon in a thickness of 0.05 microns, and depositing thereover with a Balzers vacuum coater a photogenerator layer of the pyranthrone of Example I at final thicknesses of 0.1, 0.2, 0.4, 0.6 and 0.7 micron, respectively. A current of 28 amps was used to heat the photogenerator pigment in a tantalum boat and the vacuum coater evacuated to a pressure of about 10−5 Torr. Also, the substrate was mounted 16 centimeters from the boat, and the photogenerator layer was deposited at a rate of about 2 to 8 Angstroms/second.

Thereafter, the above photogenerating layers were overcoated in each instance with an amine charge transport layer prepared as follows:

A transport layer with 50 percent by weight Makrolon, a polycarbonate resin, was mixed with 50 percent by weight N,N'-diphenyl-N,N'-bis(3-methylphenyl)-1,1'-biphenyl-4,4'-diamine to 13 percent by weight in methylene chloride in an amber bottle. The resulting solution was then coated in a dry thickness of 25 microns on top of each of the above photogenerating layers using a multiple clearance film applicator. The resulting members were then dried in a forced air oven at 135° C. for 20 minutes.

The photosensitivity of these members with the exception of the 0.7 micron member was then determined by electrostatically charging the surface thereof with a corona discharge source until the surface potential, as measured by a capacitively coupled probe attached to an electrometer, attained an initial dark value $V_O$ of −810 volts. The front surface of the charged member was then exposed to light from a filtered 150 watt Xenon lamp allowing light in the wavelength range of 400 to 700 nanometers to reach the member surface. The exposure causing reduction of the surface potential to half of its initial value, $E_{\frac{1}{2}}$, and the percent discharge of surface potential due to various exposure energies was then determined. The photosensitivity can be determined in terms of the exposure in ergs/cm$^2$ necessary to discharge the member from the initial surface potential to half that value. The higher the photosensitivity, the smaller the exposure energy required to discharge the layer to 50 percent of the surface potential. The photosensitivity results for the prepared imaging members are summarized in the following table.

| Thickness of Photogenerating Layer of Paliogen Red L3530 | $E_{\frac{1}{2}}$ ergs/cm$^2$ | % Discharge at 10 ergs/cm$^2$ |
|---|---|---|
| 0.1 micron | 43.3 | 15 |
| 0.2 micron | 30.8 | 21 |
| 0.4 micron | 15.7 | 38 |
| 0.6 micron | 3.3 | 89 |

The dark decay (loss in surface potential in the dark following charging) is less than 25 volts/second for each member.

The 0.6 micron member was more sensitive than the other members with thinner photogenerator layers. The photosensitivity results for the 0.6 micron member are illustrated in FIG. 4 where the surface potential is plotted against various exposure energies. Also, the cycling stability of the 0.6 micron member as measured by monitoring surface potential before and after white light exposure (23 ergs/cm$^2$) and erasure (300 ergs/cm$^2$) was excellent.

EXAMPLE IV

Photoresponsive imaging members were prepared by repeating the procedure of Example III with the exception that there was selected as the photogenerating pigment the pyranthrone from Example II in thicknesses of 0.1, 0.2 and 0.3 micron, respectively.

The photosensitivity of the resulting member was determined according to the procedures of Example III, with the following results:

| Thickness of Photogenerating Layer of Paliogen Orange L2640 | E½ ergs/cm$^2$ | % Discharge at 10 ergs/cm$^2$ |
|---|---|---|
| 0.1 micron | 12.3 | 41 |
| 0.2 micron | 7.7 | 59 |
| 0.3 micron | 6.3 | 72 |

The dark decay for each of the members was less than 5 volts/second. Also, the cyclic stability for the excess of 1,000 imaging cycles in a xerographic imaging test fixture was excellent, that is images with no background deposits are obtainable.

The characteristics of the imaging members of Examples III and IV indicate that such members can be selected for the generation of developed images of excellent quality with substantially no background deposits. These imaging members may be negatively charged, for example, when the photogenerating layer is situated between the hole transport layer and the supporting substrate, or positively charged when the hole transport layer is situated between the photogenerating layer and the substrate. With negatively charged imaging members, there is selected a positively charged developer composition, that is wherein the toner composition is positively charged and contains therein a charge enhancing additive such as distearyl dimethyl ammonium methyl sulfate, reference U.S. Pat. No. 4,560,635, the disclosure of which is totally incorporated herein by reference. When the imaging member is positively charged, there is selected a negatively charged developer composition comprised of resin particles such as styrene n-butyl methacrylate copolymers, and pigment particles such as carbon black, reference for example U.S. Pat. No. 4,469,770, the disclosure of which is totally incorporated herein by reference.

Other modifications of the present invention may occur to those skilled in the art subsequent to a review of the present application, and these modifications are intended to be included within the scope of the present invention.

What is claimed is:

1. A photoconductive imaging member comprised of a supporting substrate; a vacuum evaporated photogenerating layer comprised of fractionally sublimed pyranthrone compounds of the following formula,

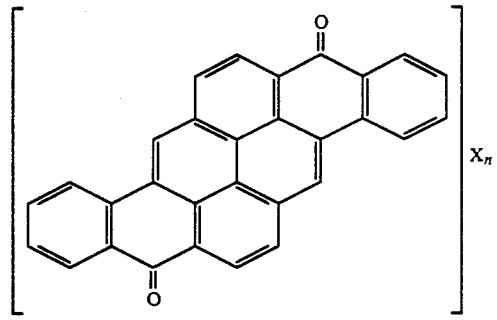

wherein X is halogen, and n is a number of from 3 to 4; and an aryl amine hole transport layer, wherein said fractionally sublimed pyranthrone compounds are subjected to a temperature of from about 200° to about 450° C. whereby impurities and decomposition products more volatile than the desired components are separated at a temperature zone of below 200° C., and there are obtained the purified pyranthrone compounds at a purity of at least about 95 percent at a temperature zone of from about 290° to 350° C., separated from the nonvolatile impurities which remain at a high temperature zone.

2. An imaging member in accordance with claim 1 wherein the halogen is chloride, bromide, iodide or fluoride.

3. An imaging member in accordance with claim 1 wherein the pyranthrone is tribromo-8,16-pyranthrenedione or trichloro-8,16-pyranthrenedione.

4. An imaging member in accordance with claim 1 wherein the vacuum deposited photogenerating layer is situated between the supporting substrate and the hole transport layer.

5. An imaging member in accordance with claim 1 wherein n is 3.

6. An imaging member in accordance with claim 1 wherein the aryl amine hole transport layer is situated between the supporting substrate and the vacuum deposited photogenerating layer.

7. An imaging member in accordance with claim 1 wherein the supporting substrate is comprised of a conductive metallic substance, or an insulating polymeric composition overcoated with an electically conductive layer.

8. An imaging member in accordance with claim 1 wherein the supporting substrate is aluminum, an organic polymeric composition, or a titanized Mylar.

9. An imaging member in accordance with claim 1 wherein the photogenerating pyranthrane is dispersed in a resinous binder in an amount of from about 5 percent by weight to about 95 percent by weight.

10. An imaging member in accordance with claim 8 wherein the resinous binder is a polyester, poly(vinyl butyral), a polycarbonate, poly(vinyl formal), or poly(vinyl chloride).

11. An imaging member in accordance with claim 1 wherein the aryl amine compound comprises molecules of the formula

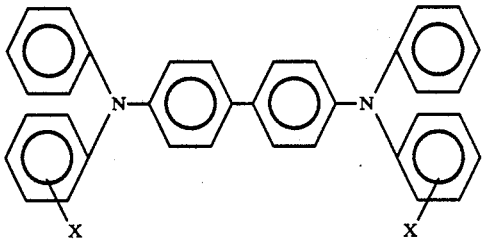

dispersed in a highly insulating and transparent organic resinous binder wherein X is selected from the group consisting of alkyl and halogen.

12. An improved imaging member in accordance with claim 11 wherein X is selected from the group consisting of ortho ($CH_3$), meta ($CH_3$), para ($CH_3$), ortho (Cl), meta (Cl), or para (Cl).

13. An imaging member comprised of (1) a supporting substrate; (2) a siloxane hole blocking layer; (3) a photogenerating layer comprised of the pyranthrone compounds of claim 1; and (4) an aryl amine hole transport layer.

14. An imaging member in accordance with claim 13 wherein there is included between the siloxane hole blocking layer and the vacuum deposited pyranthrone photogenerating layer an adhesive layer.

15. An imaging member in accordance with claim 14 wherein the adhesive layer is a a polyester resin.

16. An imaging member in accordance with claim 13 wherein the aryl amine comprises molecules of the formula

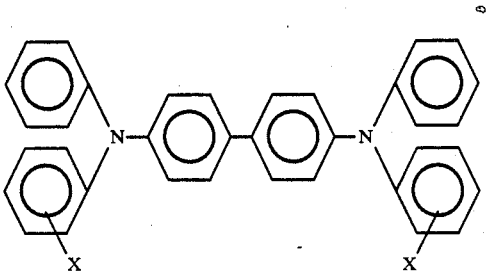

wherein X is selected from the group consisting of alkyl and halogen.

17. A photoconductive imaging member comprised of a supporting substrate; a photogenerating layer comprised of fractionally sublimed pyranthrone compounds of the following formula

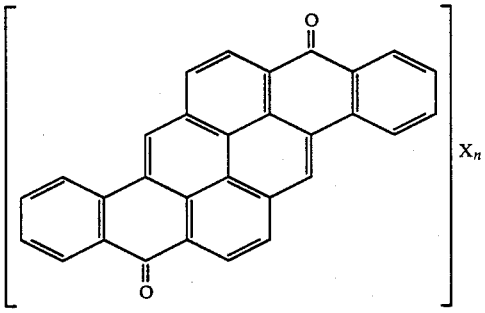

wherein X is halogen, and n is a number of from 3 to 4; and an aryl amine hole transport layer, wherein said fractionally sublimed pyranthrone compounds are subjected to a temperature of from about 200° to about 450° C. whereby impurities and decomposition products more volatile than the desired components are separated at a temperature zone of below 200° C., and there are obtained the purified pyranthrone compounds at a purity of at least about 95 percent at a temperature zone of from about 290° to 350° C., separated from the non-volatile impurities.

18. An imaging member in accordance with claim 17 wherein n is 3.

19. An imaging member is accordance with claim 17 wherein the pyranthrone is tribromo-8,16-pyranthrenedione, or trichloro-8,16-pyranthrenedione.

20. A method of imaging which comprises generating an electrostatic image on the imaging member of claim 1; developing the image generated; subsequently transferring the developed image to a suitable substrate; and thereafter permanently affixing the image thereto.

21. A method of imaging which comprises generating an electrostatic image on the imaging member of claim 13, developing the image generated; subsequently transferring the developed image to a suitable substrate; and thereafter permanently affixing the image thereto.

22. A method of imaging which comprises generating an electrostatic image on the imaging member of claim 17; developing the image generated; subsequently transferring the developed image to a suitable substrate; and thereafter permanently affixing the image thereto.

23. A method of imaging in accordance with claim 20 wherein the photogenerating layer selected for the imaging member is tribromo-8,16-pyranthrenedione, or trichloro-8,16-pyranthrenedione.

24. A method of imaging in accordance with claim 21 wherein the photogenerating layer is selected for the imaging member is tribromo-8,16-pyranthrenedione, or trichloro-8,16-pyranthrenedione.

25. A method of imaging in accordance with claim 21 wherein the photogenerating layer is selected for the imaging member is tribromo-8,16-pyranthrenedione, or trichloro-8,16-pyranthrenedione.

26. A photoconductive imaging member comprised of a supporting substrate; a photogenerating layer comprised of fractionally sublimed pyranthrone compounds of the following formula

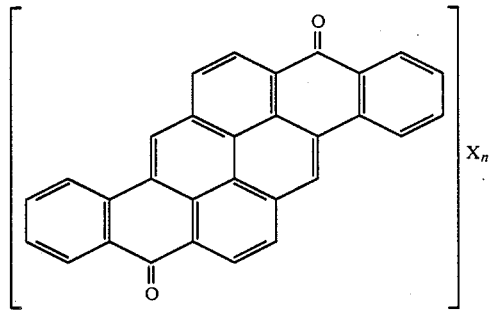

wherein X is halogen, and n is the number 3 or 4; and an aryl amine hole transport layer, wherein said fractionally sublimed pyranthrone are subjected to a temperature of from about 200° to about 450° C. whereby impurities and decomposition products more volatile than the desired components are separated at a temperature zone of below 200° C., and there are obtained the purified pyranthrone compounds at a purity of at least about 95 percent at a temperature zone of from about 290° to 350° C., separated from the nonvolatile impurities which remain at a high temperature zone of about 450° C.

27. A photoconductive imaging member consisting essentially of a supporting substrate; a vacuum evaporated photogenerating layer comprised of fractionally sublimed pyranthrone compounds of the following formula

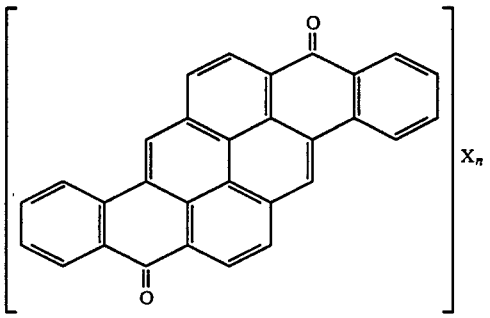

wherein X is halogen, and n is a number of from 3 to 4; and an aryl amine hole transport layer, wherein said fractionally sublimed pyranthrone compounds are subjected to a temperature of from about 200° to about 450° C. whereby impurities and decomposition products more volatile than the desired components are separated at a temperature zone of below 200° C., and there are obtained the purified pyranthrone compounds at a purity of at least about 95 percent at a temperature zone of from about 290° to 350° C., separated from the nonvolatile impurities.

28. A photoconductive imaging member comprised of a supporting substrate; a photogenerating layer comprised of a vacuum evaporated pyranthrone compound of the formula of claim 1 and wherein the pyranthrone is subjected to a fractional sublimation prior to vacuum evaporation thereof, said fractional sublimation comprising subjecting the pyranthrone compounds to a temperature of from about 200° to about 450° C. whereby impurities and decomposition products more volatile than the desired components are separated at a temperature zone of below 200° C., and there are obtained the purified pyranthrone compounds at a temperature zone of from about 290° to 350° C., separated from the nonvolatile impurities.

29. An imaging member in accordance with claim 28 wherein the purity of the pyranthrone is at least about 95 percent.

30. An imaging member in accordance with claim 28 wherein the aryl amine hole transport layer is comprised of molecules of the formula

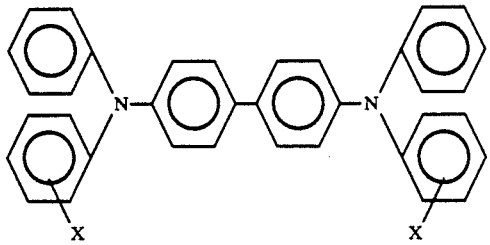

wherein X is selected from the group consisting of alkyl and halogen.

31. An imaging member in accordance with claim 28 wherein the thickness of the photogenerating layer is from about 0.1 to about 0.3 micron.

32. A photoconductive imaging member comprised of a supporting substrate; a photogenerating layer consisting essentially of a vaccum evaporated pyranthrone compound of the formula of claim 1 and wherein the pyranthrone is subjected to a fractional sublimation prior to vacuum evaporation thereof, said fractional sublimation comprising subjecting the pyranthrone compounds to a temperature of from about 200° to about 450° C. whereby impurities and decomposition products more volatile than the desired components are separated at a temperature zone of below 200° C., and there are obtained the purified pyranthrone compounds at a temperature zone of from about 290° to 350° C., separated from the nonvolatile impurities which remain at a high temperature zone.

33. An imaging member in accordance with claim 32 wherein the purity of the pyranthrone is at least about 95 percent.

34. A process for the preparation of a photoconductive imaging member which comprises providing a supporting substrate; applying to the supporting substrate by vacuum evaporation the photogenerating layer pyranthrone compounds of the formula of claim 1 subsequent to the fractional sublimation thereof wherein R is halogen, n is a number of from 3 to 4, wherein said fractionally sublime pyranthrone compounds are subjected to a temperature of from about 200° to about 450° C. whereby impurities and decomposition products more volatile than the desired components are separated at a temperature zone of below 200° C., and aryl amine hole transport layer.

35. A process in accordance with claim 34 wherein the aryl amine hole transport molecules are of the formula

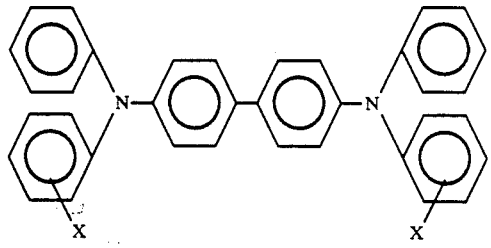

wherein X is selected from the group consisting of alkyl and halogen.

* * * * *